US005260528A

United States Patent [19]

Benda

[11] Patent Number: 5,260,528

[45] Date of Patent: Nov. 9, 1993

[54] LOCK OUT FOR WALL SWITCHING MEANS

[76] Inventor: Steven J. Benda, P.O. Box 782, Cokato, Minn. 55342

[21] Appl. No.: 815,051

[22] Filed: Dec. 30, 1991

[51] Int. Cl.[5] ..... H01H 9/28

[52] U.S. Cl. ..... 200/43.14; 200/43.22

[58] Field of Search ..... 200/43.22, 43.16, 43.14, 200/43.11, 43.19, 333, 334, 43.13, 43.18

[56] References Cited

U.S. PATENT DOCUMENTS

| | | | |
|---|---|---|---|
| 1,168,066 | 1/1916 | Girardot | 200/43.22 X |
| 2,169,860 | 8/1939 | Von Hoorn | 200/43.22 |
| 3,096,409 | 7/1963 | Hubbell et al. | 200/43.22 |
| 4,607,900 | 8/1986 | Andrews et al. | 200/43.22 X |

FOREIGN PATENT DOCUMENTS

| | | | |
|---|---|---|---|
| 1451954 | 10/1976 | United Kingdom | 200/43.22 |

*Primary Examiner*—Renee S. Luebke

*Attorney, Agent, or Firm*—Paul H. Gallagher

[57] ABSTRACT

A single, one-piece molded plastic article that includes a base and cover on opposite sides of hinge means, for a wall switch, and for a wall socket, both of the kind having a cover plate held on by a screw. The base is secured to the cover plate of the switch by the same screw holding the cover plate itself. The device includes three forms. a) A first form has a hole in the base and in the cover, the cover closing down on the base, with the actuating lever of the switch extending through those holes, and the actuating lever is thereby held against movement. b) The base has apertured lugs with locking holes therethrough, that are extended through the holes in the base and cover; supplementary locking means is positioned in those apertures. c) For use with a wall socket, the base has insulating prongs extended into the socket, and the base and cover have locking lugs for cooperating with supplementary locking means when the cover is in closing position.

9 Claims, 3 Drawing Sheets

LOCK OUT FOR WALL SWITCHING MEANS

This invention is related to U.S. Pat. No. 5,122,624, dated Jun. 16, 1992.

FIELD OF THE INVENTION

The invention resides in the broad field of switching means that includes generically a switch having an external switching lever, and a socket which, by having a plug inserted thereinto, performs a switching function.

Such switching means customarily includes internal switching elements covered by a cover plate or wall plate detachably secured to the wall, and certain other switching elements exposed through the cover plate to the exterior.

BRIEF SUMMARY OF THE INVENTION

The invention includes a device, of different forms, for locking such wall switching means against actuation by unauthorized persons.

Broadly, the device of the invention is of unusual construction, that includes a base secured to the cover plate, and a cover over the base, locking the exposed switching elements to render them inoperable.

Another broad object is to provide a device of the character referred to, which enables the use of supplementary locking means, to provide an additional measure of security.

More specifically, the device is of one-piece molded construction, having a pair of main parts forming a base and cover hinged together, which results in a simple and inexpensive article and wherein the material of which it is formed, can be flexed numerous times without failure, in swinging the parts into and out of closed position.

Another object is to provide a device of the foregoing character, which is well adapted to be mounted on a cover plate, and thus securely mounted, and which also covers and encloses and confines the means for mounting the device.

DETAILED DESCRIPTION

As noted above, the device of the invention is for use with switching means of well known kind, which include generically, (a) a switch having an actuating lever, and (b) a socket. In both cases the switching means has a major portion mounted in the wall, and certain switching elements exposed to the exterior, i.e., exposed in the room or space defined by the wall, for actuation by a user. For convenience, and for generic reference, the portion embedded in the wall is herein referred to as including switching elements; in the case of the switch, those elements include inner contacts, and a common contact on the switch lever that is selectively engageable with those inner contacts to perform a selected function; in the case of the wall socket, the switching elements embedded in the wall include spaced apart contacts, which cooperate with the prongs of the plug inserted thereinto from the exterior In both cases a switching function is performed, and hence the generic designation of switching means. The device of the invention assumes different forms, for effective use with those different forms of switching means.

Figure 2:
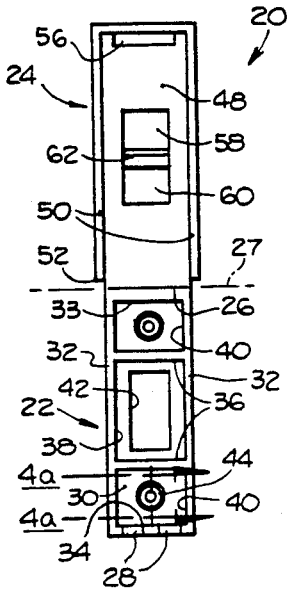
FIG. 2 is a face view of the lock out shown in FIG. 1 in open position.
Figure 1:
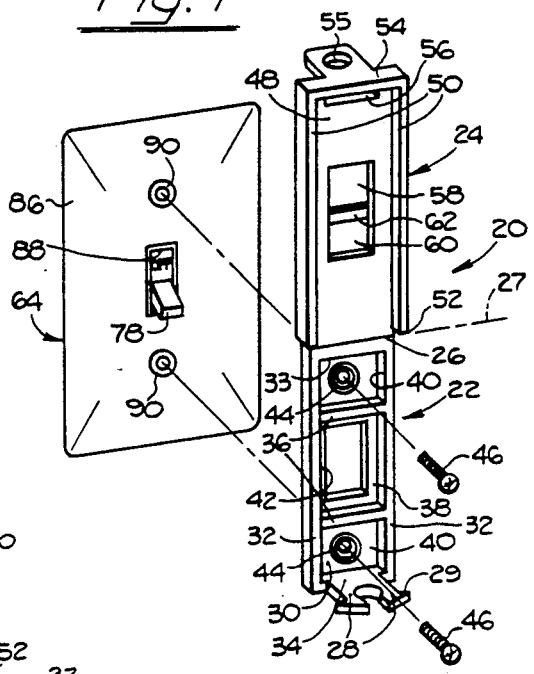
FIG. 1 is perspective view of one form of the device of the invention, in open position, in association with a wall switch with which it is to be used.
Figure 5:
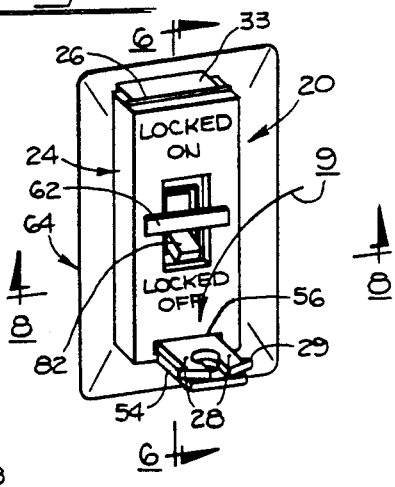
FIG. 5 is a perspective view oriented according to FIG. 3, but with the cover in closed position.

A first form of the device of the invention in shown in FIGS. 1-10. This device is indicated as a whole at 20 and is a one-piece, molded article preferably made of polypropylene. It includes two main parts, a base 22 and a cover 24 having an interconnecting thin portion 26 forming hinge means enabling them to be moved between an open position as shown in FIG. 1 and a closed position as shown in FIG. 5. The base and the cover are each referred to as having a hinge end at the hinge means and a free or swinging end.

The material of which the device is molded, is generally rigid and maintains its shape in all of its elements, except in the case of the hinge means 26 which is readily and easily flexed about a transverse axis 27, and certain fingers 28 which have limited flexibility toward and from each other. These fingers are spaced apart and have latching hooks 29 on their extended ends. The various elements may also be referred to as oriented in FIGS. 4 and 6.

The base 22 includes a bottom element 30, side flanges 32 and end flanges 33, 34. The end flange 33 at the hinge end, is preferably of the same height as the side flanges, while the flange 34 is extended upwardly beyond the side flanges and includes the fingers 28 referred to, and which will be referred to again hereinbelow.

Figure 4A:
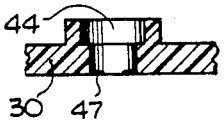
FIG. 4*a* is a sectional view taken at line 4*a*—4*a* of FIG. 2.

Interconnected to and between the side flanges are cross flanges 36 which form a center cell 38 and end cells 40. In the center cell 38, the bottom element 30 has a relatively large hole or opening 42 for receiving the switch lever as referred to hereinbelow, and in the end cells 40, the bottom element has holes 44 for receiving screws 46 which are part of the switch with which the device is to be used, as will be referred to again hereinbelow. An advantageous feature of the invention is the provision of flash 47 (FIG. 4*a*), produced in the molding step, forming a membrane at least partially covering the holes 44 at the bottom ends of the latter, i.e., in the under surface of the base. This flash provides a tight binding effect with the screws 46 upon insertion of the screws. This feature may also be included in the forms of FIGS. 11-14 and FIGS. 15-18.

The cover 24 is generally in the form of a channel, including a structural element 48, which in the closed position of the cover becomes a top element, and side flanges 50 extending from the element 48. At the hinge end, the flanges are free-standing, at 52, i.e., there is no cross flange between the side flanges, and the end of the channel is open. At the free end, an end piece 54 is connected with the top element 48 and the side flanges. This piece 54 extends above the flanges (in closed position, FIG. 5) and is provided with a hole 55 for receiving locking means, to be referred to again hereinbelow. The top element 48 is provided with two holes 58, 60 adjacent the center and separated by a cross bar 62. This cross bar functions in connection with holding the switch lever in position to which it has been moved, when applied to the switch as referred to again hereinbelow.

Figure 3:
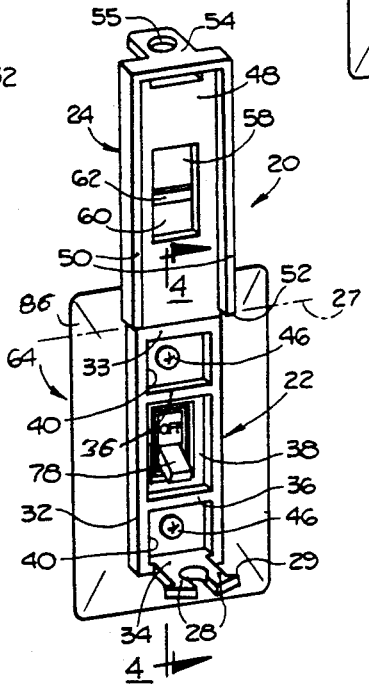
FIG. 3 is a perspective view of the lock out secured to the wall switch.
Figure 4:
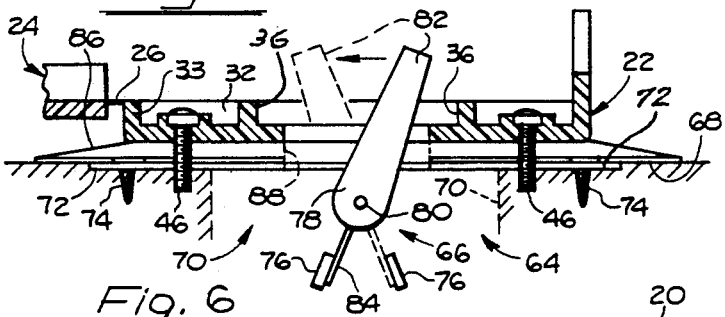
FIG. 4 is a sectional view taken at line 4—4 of FIG. 3.
Figure 7:
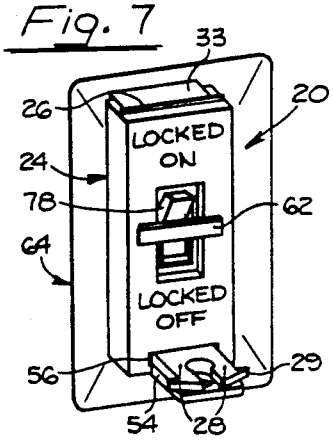
FIG. 7 is a view similar to FIG. 5 but with the switch lever in opposite position.
Figure 6:
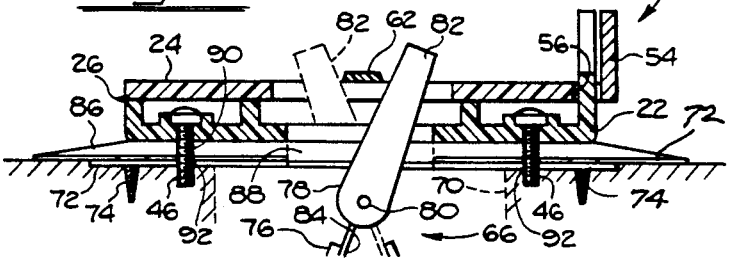
FIG. 6 is a sectional view taken at line 6—6 of FIG. 5.
Figure 8:
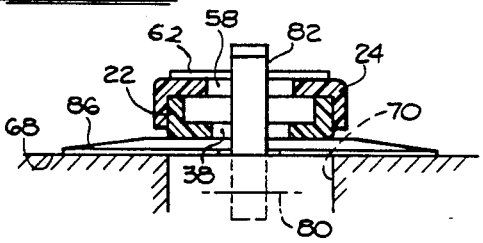
FIG. 8 is a sectional view taken at line 8—8 of FIG. 5.
Figure 9:
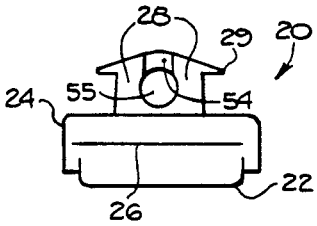
FIG. 9 is a detail face view oriented according to the arrow 9 in FIG. 5.
Figure 10:
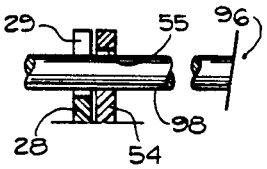
FIG. 10 is a view oriented according to FIG. 6, and showing elements of FIG. 6 at the upper right hand corner thereof.

FIGS. 1-5 show a wall switch 64 of known construction. As shown in FIG. 4, it includes as a major portion of its construction, a number of elements 66 referred to as switching elements for convenience, embedded in a recess 70 in the wall 68. The switch includes a metal box-like member having tabs 72 by which it is secured in the wall, as by screws 74.

The switching elements include spaced apart contacts 76 and a switch lever or tongue 78 swingable on an axis 80 with its outer end 82 exposed to the exterior, i.e., in the room or space bounded by the wall. This switch lever is accessible to the user, and is angularly movable between the opposite positions indicated in FIG. 4. The lever 78 has a common contact 84 engageable selectively with the contacts 76 on swinging the lever. A cover plate or wall plate 86 is mounted over the recess 70, and has a central hole 88 for receiving the switch lever 78. The cover plate is provided with apertures 90, and to mount it on the switch, it is fitted thereover, as indicated above, and the screws 46, are inserted through the apertures 90 and into tapped holes 92 in the mounting tabs 72, thus securing the cover plate in position.

To apply the lock out to the wall switch, the securing screws 46 are removed, and with the lock out in open position, it is fitted to the cover plate, with the apertures 44 in register with the apertures 90, the screws 46 are re-inserted therethrough, and then threaded into the tapped holes 92. In this step, the flash or membrane 47 is penetrated by the screws and aids in tightly securing the lock out in position, as referred to above.

In so locking the lock out, and the switch, the switch lever 78 is first moved to OFF position, as indicated, and the cover 24 folded down to closed position (FIG. 5). The lever 78 then extends through the corresponding hole 58. In this position of the switch lever, and the lock out applied to the switch, the cross bar 62 fits against the switch lever and holds it in the position assumed.

If it should be desired to lock the switch lever 78 in its opposite or ON position (FIG. 7), it would be positioned in the other one of the holes 60, in response to the cover being folded down to closed position, and in this case also, the cross bar 62 would engage the lever and hold it in that position. It is pointed out that it is less often that the switch would be locked in the ON position, but the device is adapted to that usage, if it should be desired.

In either position of the lever 78, the cross flanges 36 obstruct the view through the holes 58, 60 in the cover into the end cells 40 and thereby hide the screws 46 in the end cells and thus eliminate a temptation to tampering.

In connection with using the lock out selectively in OFF or ON position, the cross bar 62 is made of such predetermined thickness, or width, longitudinally of the cover, and the holes 58, 60 correspondingly spaced apart, and of such dimensions, that the cross bar 62 is closer to the switch lever 78 in ON position than in OFF position, because, in common construction, the switch lever need be moved only a small amount to be moved out of full ON position, while it must be moved a greater amount to be moved to the ON position. The position of the cross bar therefore confines the switch lever to less movement while in ON position than in OFF position.

It is also within the scope of the invention that the base be so designed that the lock out can be applied in the position opposite that represented in FIGS. 1, 3, 5, in a given position of the switch lever, enabling the lock out to be positioned selectively, end for end, to position the appropriate one of the holes 58, 60 to receive the switch lever.

In moving the cover 24 to closed position, the hole 56 receives the fingers 28, the fingers flexing toward each other, and after the hooks 29 pass through the hole, the fingers spring apart and the hooks latch the cover and normally hold it in closed position. To release the cover to enable it to be opened, the fingers are pinched together, enabling the hooks 29 to again ride through the opening 56.

For providing additional security, (FIG. 10) an element 98 of a supplementary padlock 96 may be inserted through the hole 55, which thereby serves to prevent pinching or moving together of the fingers 28, and thus effectively locking the cover in closed position.

Attention is directed next to FIGS. 11-14 showing a second form of the invention. In the present case the lock out is indicated in its entirety at 100, and like the first form, is made of a one-piece molded article, and also preferably of the same material. It includes the same two main parts, a base 102 and a cover 104, of rigid material, interconnected by a thin piece 106 forming hinge means.

In the present case, the base includes a bottom element or floor element 108, having a central hole 110 preferably of rectangular shape. A pair of ears or lugs 112 extend upwardly from the floor element at opposite side edges of the hole and have aligned apertures 114. At the ends of the bottom element, spaced from the center hole, are screw holes 115.

The cover 104 includes an element 116, which may be referred to as a top element, has surrounding flanges 118. The element 116 is provided with a central hole 120, preferably rectangular, and of a size approximately that of the hole 110, although not necessarily so. The hole 120 is adapted for receiving the lugs 112, in the closed position of the cover.

Figure 11:
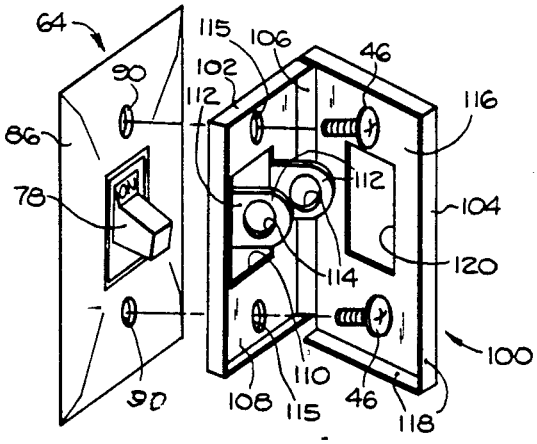
FIG. 11 is a perspective view of another form of device of the invention in association with a wall switch.
Figure 12:
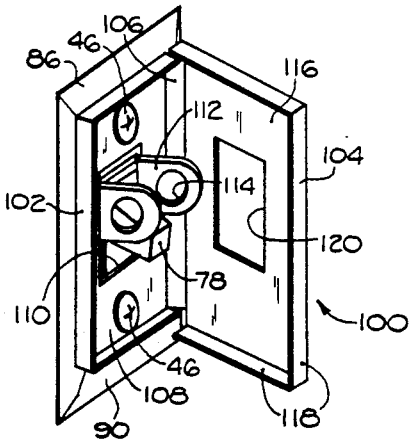
FIG. 12 is a view oriented according to FIG. 11 but showing the device secured to the switch.

As in the previous case, the lock out is used with a wall switch 64, such as identified above, including the cover plate or wall plate 86, held in place by the screws 46. FIG. 11 also shows the switching lever 78. In applying the lock out 100 of FIG. 11, to the switch, the screws 46 are removed, and then with the lock out in open position, the base is positioned on the cover plate, and the apertures 115 aligned with the apertures 90. The screws 46 are then re-inserted, to secure the lock out to the switch, in the manner described above.

The lugs 112 extend from the central hole 110 in the base; the cover is closed down on the base, and in the latter step, the lugs 112 of course extend through the hole 120 in the cover and are exposed therethrough, to the exterior of the switch assemblage.

Then a supplemental lock 122 is applied by extending the element 124 thereof through the aligned apertures 114. It will be noted that the element 124 is positioned to the side of the switch lever 78 and it thereby holds the latter from being repositioned.

Figure 13:
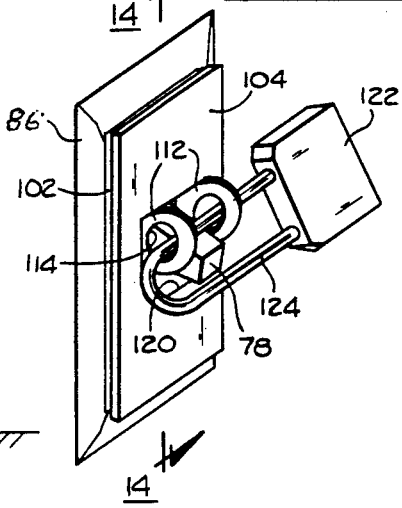
FIG. 13 is a view oriented according to FIG. 12 but with the cover of the device in closed position over the base, and with a supplementary lock secured in place.
Figure 14:
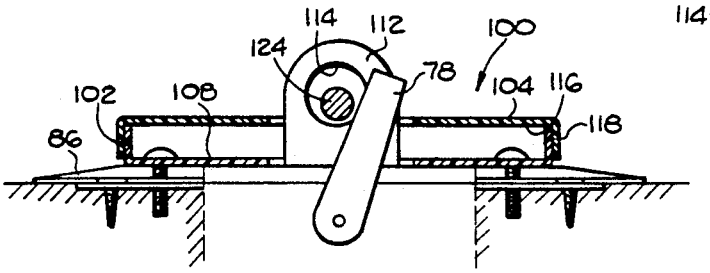
FIG. 14 is a sectional view taken at line 14—14 of FIG. 13.
Figure 15:
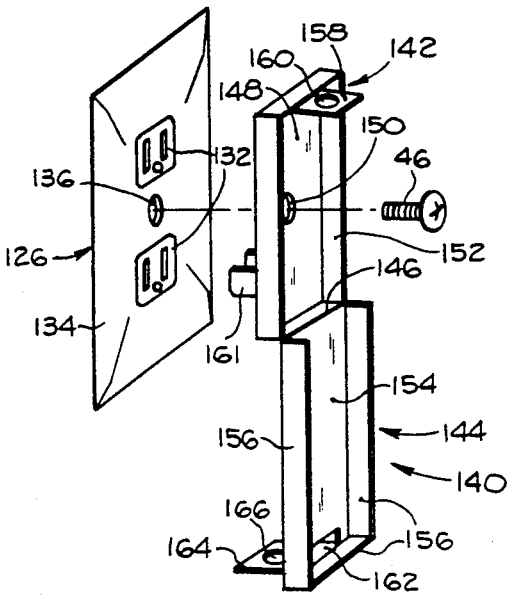
FIG. 15 is a view similar to FIG. 11 but showing a third form of device, in association with a wall socket
Figure 16:
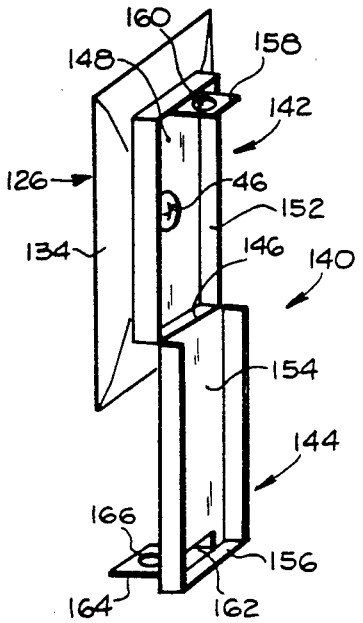
FIG. 16 is a view similar to FIG. 15 but showing the device secured to the cover plate.
Figure 18:
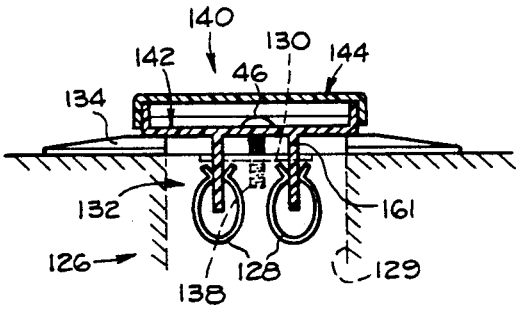
FIG. 18 is a sectional view taken at line 18—18 of FIG. 17.
Figure 17:
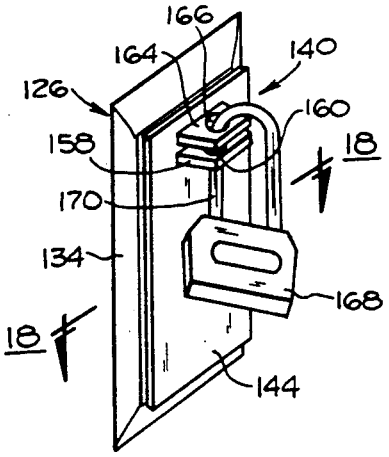
FIG. 17 is a view similar to FIGS. 15 and 16, showing the cover in closed position and with a supplementary lock in place.

It will be noted that the lugs 112 are spaced at a certain distance from the ends of the hole 110 (as oriented in FIG. 11) to accommodate the switch lever 78 in that angular position, i.e., that position shown in FIG. 13. If it should be desired to lock the switch lever in the opposite position, then the lock out can be turned end for end relative to that shown, and then the lock element 124 will bear against the switch lever on the opposite side, and hold it in its then position. It is also within the scope of the invention to make the hole 110 longer, i.e., longer in direction from top to bottom as oriented in FIG. 11, so that the lock out may be positioned in the same position, considered end for end, regardless of the position of the switch lever 78.

Reference is next made to FIGS. 15–18 showing a form of the device applied to a wall socket 126. As in the case of the wall switch, the socket has certain interior electrical elements. Since such a wall socket is well known, it need not be described in detail, but it is pointed out that it includes contacts 128 in the interior. The electrical elements including these contacts are embedded in a recess 129 in the wall and it includes mounting tabs 130 for mounting the device on the wall. The wall socket has a pair of socket units 132 exposed to the exterior, each for the insertion of a plug having prongs. The prongs upon being inserted into the slots in the socket, engage the contacts 128, and thus perform a switching operation. This switching operation is considered generic, in the present case in referring to the three devices for use with the switching means, that is, the switch and the socket.

The socket includes a cover plate or wall plate 134 having a central aperture 136 through which a screw 46 is inserted and threaded into a tapped hole 138 (FIG. 18) for holding the cover plate in place.

The lock out in the present case, FIGS. 15–18, is indicated in its entirety at 140, and as in the cases of the other lock outs, it is an integral one-piece, molded material, preferably of high dielectric properties. It includes two main parts, namely a base 142 and a cover 144 secured together by a thin portion 146 constituting a hinge between the parts, enabling the base and cover to be moved into and out of a closed position. The base 142 includes a floor element 148 which has a central aperture 150, and is surrounded by upstanding flanges 152. The cover 144 is generally similar in shape to the base, having an element 154 which in the closed position constitutes a top element, surrounded on three sides by flanges 156. As in the previous cases, these main parts, 142, 144 have a hinge end and a free or swinging end respectively. At the free end of the base 142 is an upstanding lug 158 having an aperture 160 therethrough. The cover at its free end has a hole 162, and at the outer edge of the hole, i.e., at the free end of the cover, the cover has a lug 164 which itself has an aperture 166 therethrough. The base has a pair of insulating prongs 161, which enter into the slots in the socket, as referred to again hereinbelow.

The lock out is applied to the socket in a manner very similar to that of the lock out of the first two forms. In so applying it, the screw 46 is removed, as indicated, and then the base is fitted to the cover plate. In so fitting it, the prongs 161 are inserted in the socket unit, and this positions the base relative to the cover plate 134, so that the aperture 150 is aligned with the aperture 136, and then the screw 46 is re-inserted through those apertures into the tapped hole in the switching means. Then the cover 144 is swung over the base, to closing position, and in this step the lug 158 extends through the aperture 162 and in the folding position, it fits against the lug 164, and the apertures 160, 166 are then aliqned. Thereafter a supplemental lock such as a padlock 168 is put in place, by inserting a lock element 170 thereof through the aligned apertures 160, 166, and locked. It should be noted that the pinch technology as represented in FIGS. 1–10 also applies here. The lock out is then entirely locked against intrusion by an unauthorized person. As in the other cases, the flanges 152, 156 entirely enclose the interior of the lock out, against intrusion thereinto by an unauthorized person.

The prongs 161, upon their insertion into the socket unit, engage the interior contacts 128 (FIG. 18), and although it is not essential that the lock out have prongs 161, for the purpose of securing the lock out to the socket, these prongs maintain the orientation of the lock out 140 with reference to the wall socket assembly, thus preventing access to the wall socket 132.

I claim:

1. A lockout for wall switching means that includes internal switching elements in a wall in which it is mounted, and second switching elements, including an actuating lever, exposed to the exterior for access to a user for actuating the switching means, and the switching means includes first securing elements for cooperation with securing means for securing a cover plate over the internal switching elements, said lock out comprising, a one-piece molded member including a base and a cover, the base having second securing elements for cooperation with said securing means and with the first securing elements for securing the base in locking position over the internal switching elements, the cover being foldable into a closed position on the base and when in that position confining the securing means against access from the exterior, the lock out being operable, when the cover is in closed position, for preventing the switching elements from being activated, the base and cover having locking elements which, when the cover is in closed position, are positioned for cooperation with supplemental locking means for locking the cover in closed position, the base has an opening for receiving the actuating lever, and the cover has an opening for receiving the actuating lever in a selected position of the latter and is thereby operable for locking the actuating lever in the selected position.

2. A lock out according to claim 1 wherein, the cover has a pair of openings for receiving the actuating lever in each of its opposite positions respectively, and is operable for locking it in each selected position.

3. A lock out according to claim 2 wherein, the cover has a cross bar separating said openings therein, and the cross bar engages the switch lever and thereby retains it in position.

4. A lock out according to claim 3 for a wall switch wherein the lever has opposite OFF/ON positons of such characteristics that the lever need be moved only a small distance to be moved out of ON position, and a relatively greater distance fro OFF to ON position, wherein, the cross bar is so positioned, along a line between said positions of the lever, that in a given end-for-end position of the lock out, the cross bar is closer to the lever in its ON position than when the lever is in OFF position.

5. A lock out for wall switching means that includes internal switching elements in a wall in which it is mounted, and second switching elements exposed to the exterior for access to a user for actuating the switching means, and the switching means includes first securing elements for cooperation with securing means for securing a cover plate over the internal switching elements, said lock out comprising, a one-piece molded member including a base and a cover, the base having second securing elements for cooperation with said securing means and with the first securing elements for securing the base in locking position over the internal switching elements, the cover being foldable into a closed position on the base and when in that position confining the securing means against access from the exterior, the lock out being operable, when the cover is in closed position, for preventing the switching elements from being activated, the base and cover having locking elements which, when the cover is in closed position, are positioned for cooperation with supplemental locking means for locking the cover in closed position, the base and cover constituting main parts and the molded member including hinge means between and interconnecting them, and the main parts having free ends remote from the hinge means, the base having latching fingers biased apart to a normal position and having limited yieldability toward each other, the cover having a hole receiving the latching fingers in the latched position, and the latching fingers being operable upon their being moved toward each other for releasing the latching elements.

6. A lock out according to claim 5 wherein, the cover has an end piece on its free end having a hole therethrough, and the device is capable of having a locking element of a supplemental locking means inserted through said hole in the end piece and between said latching fingers, said locking element thereby preventing movement of the latching fingers toward each other and thereby preventing unlatching of the latching fingers.

7. A lock out for wall switching means that includes internal switching elements in a wall in which it is mounted, and second switching elements exposed to the exterior for access to a user for actuating the switching means, and the switching means includes first securing elements for cooperation with securing means for securing a cover plate over the internal switching elements, said lock out comprising, a one-piece molded member including a base and a cover, the base having second securing elements for cooperationg with said securing means and with the first securing elements for securing the base in locking position over the internal switching elements, the cover being foldable into a closed position on the base and when in that position confining the securing means against access from the exterior, the lock out being operable, when the cover is in closed position, for preventing the switching elements from being activated, the base and cover having locking elements which, when the cover is in closed position, are positioned for cooperation with supplemental locking means for locking the cover in closed position, the lock out having a longitudinal direction, the base and cover each having a hinge end and a free end, the base having a bottom element with upstanding elements at its edges, the upstanding element including side flanges, a first end piece at the hinge end to which the hinge means is connected, and a second end piece at the free end, the base including cross flanges spaced apart forming a center cell therebetween, and end cells longitudinally therebeyond, the bottom element having in said center cell a hole therethrough, and having in said end cells holes for receiving securing means, the cover having a top element and downwarldy extending side flanges and a downwardly extending second end piece at its free end interconnecting the side flanges of the base, the top element of the cover having holes therethrough spaced apart longitudinally by a cross bar, these holes registering with said center cell in the base when the cover is in closing position, the top element also having an end aperture at said free end adjacent said second end piece, said second end piece including a projection extending above the bottom element, and said projection having latching prongs spaced apart laterally and extending longitudinally toward the hinge end, said second end piece at the free end of the base having a projection extending above the side flanges, and this projection including a pair of laterally spaced latching fingers, biased apart but having limited yieldability toward each other, and said latching elements on the cover engage the opposite outer sides of the latching fingers upon movement of the cover to closed position, and the latching fingers and latching elements thereby normally hold the cover in closed position.

8. A lock out according to claim 7 wherein, the cross flanges obstruct view through the holes in the cover into the end cells and thereby hide screws in the end cells from view.

9. A lock out for wall switching means that includes internal switching elements in a wall in which it is mounted, and second switching elements exposed to the exterior for access to a user for actuating the switching means, and the switching means includes first securing elements for cooperation with securing means for securing a cover plate over the internal switching elements, said lock out comprising, a one-piece molded member including a base and a cover, the base having second securing elements for cooperation with said securing menas and with the first securing elements for securing the base in locking position over the internal switching elements, the cover being foldable into a closed position on the base and when in that position confining the securing means against access from the exterior, the lock out being operable, when the cover is in closed position, for preventing the switching elements from being activated, the base and cover having locking elements which, when the cover is in closed position, are positioned for cooperation with supplemental locking means for locking the cover in closed position, the lock out including a construction wherein further, the cover plate has a third securing element the second securing elements in the base are in register with the third securing element, the securing means cooperates with all said securing elements for locking the base and the cover plate, to the switching means, the first securing element being tapped holes, the second and third securing elements being holes enabling the passage of a screw therethrough, the securing means are screw threaded into the tapped holes, the second securing elements in the base being constituted by holes through the base, the base having an under surface being engaged with the cover plate when the base is secured in locking position, and the base including flash at least partially extending over the holes constituting said second securing elements to produce a tight binding effect.

* * * * *